United States Patent [19]

Cookman

[11] Patent Number: 4,829,315

[45] Date of Patent: May 9, 1989

[54] DUAL FREQUENCY FEED APPARATUS

[76] Inventor: William T. Cookman, P.O. Box 626, Lakota, N. Dak. 58344

[21] Appl. No.: 6,005

[22] Filed: Jan. 21, 1987

[51] Int. Cl.[4] ..... H01Q 21/30

[52] U.S. Cl. ..... 343/779; 343/772; 343/786

[58] Field of Search ..... 343/779, 786, 783, 784, 343/786, 799, 772, 840

[56] References Cited

U.S. PATENT DOCUMENTS 3,025,515 3/1962 Fairbanks ..... 343/784

FOREIGN PATENT DOCUMENTS 0155761 9/1985 European Pat. Off. ..... 343/779

*Primary Examiner*—William L. Sikes

*Assistant Examiner*—Doris J. Johnson

*Attorney, Agent, or Firm*—Robert E. Kleve

[57] ABSTRACT

The invention comprises a switching mechanism for a micro wave signal dish receiver apparatus. The mechanism has means for switching a wave guide of a 12 GHZ frequency signal into and out of concentric alignment with the center of a 4 GHZ wave guide of the apparatus. The 12 GHZ wave guide when switched out of alignment is retracted so as not to interfere with the 4 GHZ wave guide while the 4 GHZ wave guide is made operative to receive a signal of that frequency. The mechanism can project the 12 GHZ guide into the center of the 4 GHZ wave guide to receive a signal of a 12 GHZ frequency at the same focal point substantially as the focal point of the 4 GHZ, without the 4 GHZ wave guide interfering with the 12 GHZ wave guide operation.

2 Claims, 2 Drawing Sheets

FIG. 3
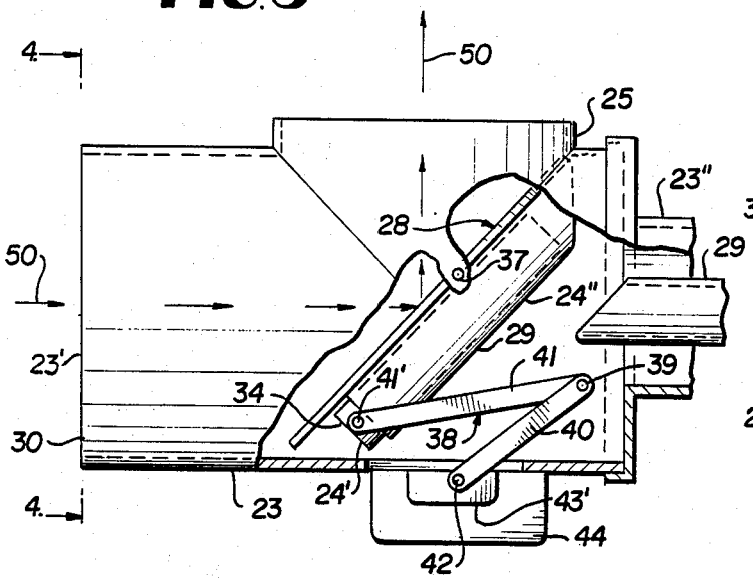
FIG. 4
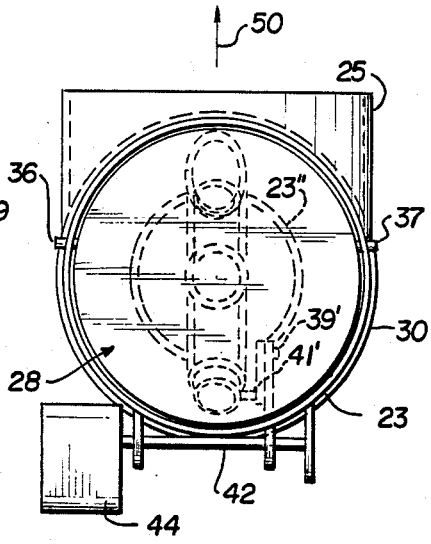
FIG. 5
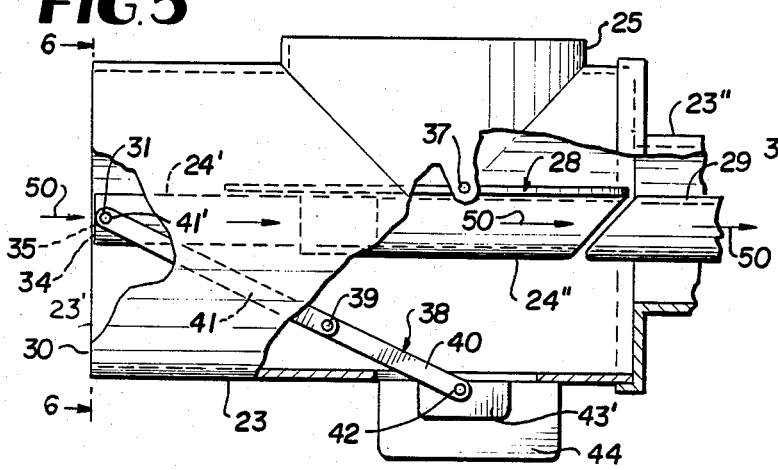
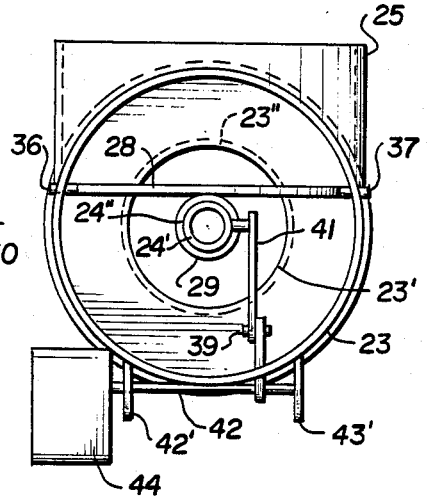
FIG. 6
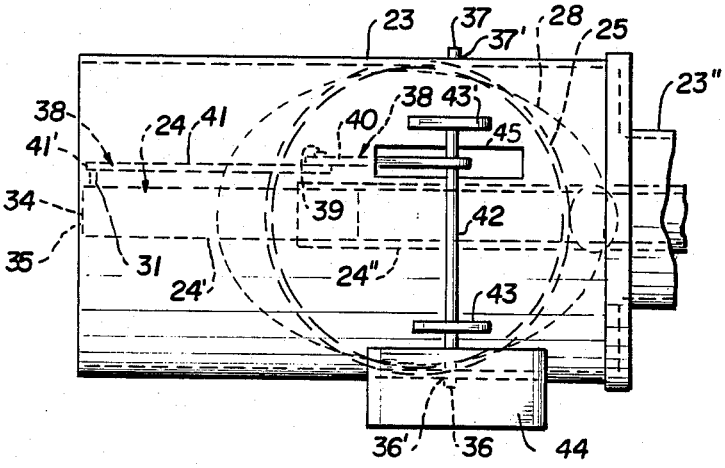
FIG. 7

DUAL FREQUENCY FEED APPARATUS

The invention relates to signal receiving apparatus.

It is an object of the invention to provide a novel satellite signal receiver which can switch from one wave guide to another to align wave guides of different frequencies coaxially with a satellite dish for accurately receiving the signal from either frequency at the focal point for the reflected signal.

It is a further object of the invention to provide a novel mechanism for positioning one wave guide alternatively into concentric relation to another wave guide for alternatively receiving the signal into one or the other wave guide more accurately at the focal point as reflected from a dish.

It is a further object of the invention to provide a novel inexpensive mechanism for more accurately receiving the signal from a selected frequency at is focal point.

Further objects and advantages of the invention will become apparent as the description proceeds and when taken in conjunction with the accompanying drawings wherein.

Figure 2:
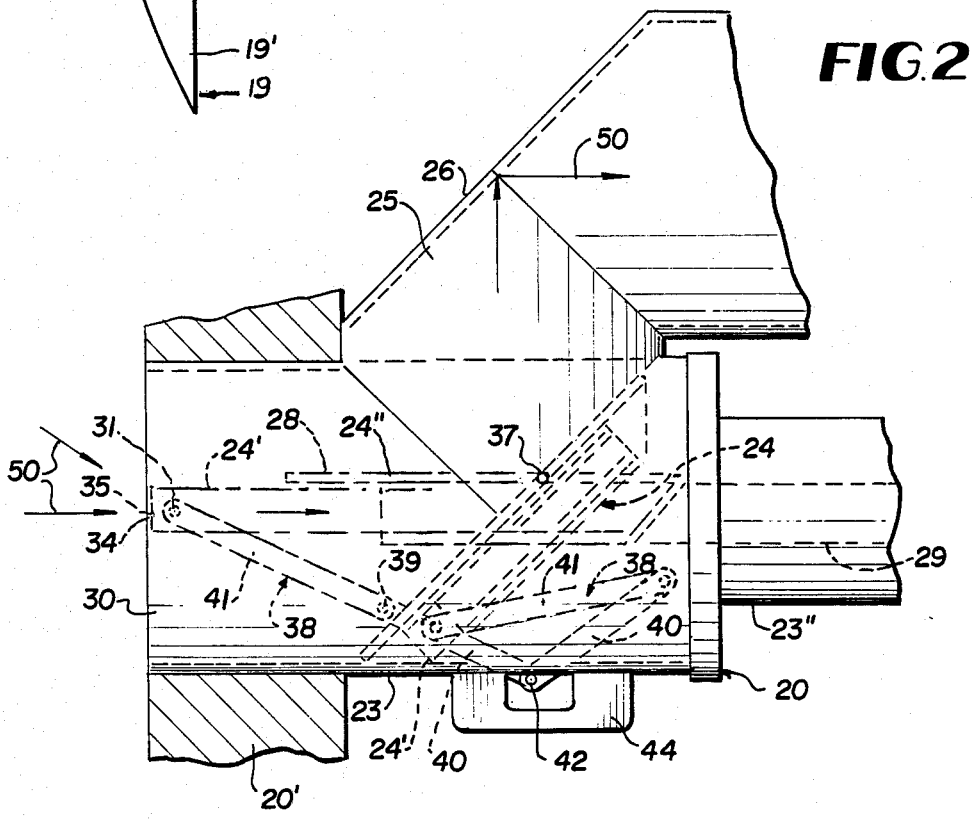
FIG. 2 is an enlarged fragmentary view of the mechanism for alternatively switching wave guides into operative alignment.

FIG. 2 shows the 12 GHZ waveguide in operative position in phantom lines, and shows in dashed lines the 12 GHZ tube like waveguide pivoted to an inoperative position and the 4 GHZ waveguide in operative position.

FIG. 3 is an enlarged fragmentary side view of the mechanism for switching wave guides, with the waveguide mechanism for the 4 GHZ signal in solid lines for its operative position to receive and reflect the 4 GHZ signal at a 45 degree angle into an amplification system, and with the 12 GHZ wave guide pivoted out of operative position and retracted so as not to interfere with the operation of receiving and amplifying the 4 GHZ signal.

FIG. 4 is an end view of FIG. 3 taken along line 4—4 of FIG. 3.

FIG. 5 is an enlarged fragmentary side view of the mechanism for switching waveguides with the telescoping 12 GHZ waveguide telescoped and extending in an operative position, and with the 4 GHZ waveguide sleeve in inoperative position and condition by the deflecting plate being pivoted parallel with the center axis of the stationary sleeve.

FIG. 6 is an end view of the mechanism taken along line 6—6 of FIG. 5.

FIG. 7 is an end view of the mechanism rotated ninety degrees from the view shown in FIG. 5 about axis 50.

Briefly stated, the invention comprises a dish microwave signal receiving apparatus having a mechanism for switching a waveguide of 12 GHZ frequency signal into and out of concentric alignment to the center of a 4 GHZ frequency waveguide so that the 4 GHZ waveguide may receive a signal of that frequency reeflected from a signal receiving dish at the center of its receiving end at the focal point of the reflected signal and guide and feed the signal to an amplification system without the 12 GHZ waveguide interfering, the 12 GHZ waveguide being pivoted out of the way; or alternatively, switching the 12 GHZ wave guide into the center of the 4 GHZ wave guide so that the 12 GHZ wave guide can receive a signal of that frequency at the reflected focal point of the signal at the center of its receiving end accurately without the 4 GHZ wave guide affecting the 12 GHZ significantly while the 12 GHZ is in the same focal point as the 4 GHZ waveguide.

Figure 1:
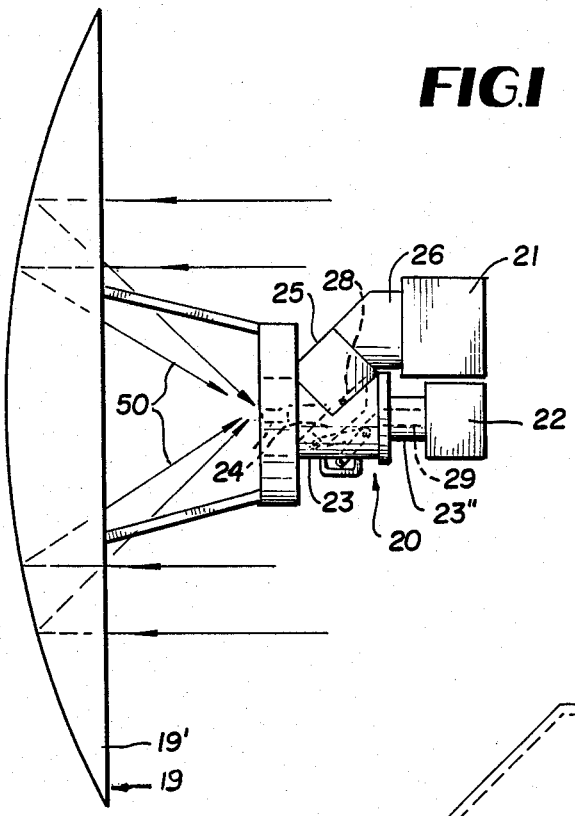
FIG. 1 is a side elevational view of the satellite dish receiver with the mechanism for alternatively switching one waveguide or the other into operative position concentric with the center of the dish and spaced forward thereto, with one sleeve shown in phanton lines.

Referring more particularly to the drawings, in FIG. 1 the satellite dish receiver 19 is illustrated having a conventional dish 19 with the mechanism 20 for guiding the signal reflected from the dish of a 12 GHZ frequency into an amplification system 22 or alternatively guiding a reflected signal of the 4 GHZ frequency into an amplification system 21.

The mechanism 20 has a tubular sleeve 23 of the diameter to conveniently guide a signal of 4 GHZ therethrough into the amplification system 21. The mechanism 20 also has a smaller sleeve 24 of a size to conveniently guide a signal of 12 GHZ frequency therethrough along its center axis into an amplification system 22. The sleeve 23 is mounted to a conventional mounting plate and scaling ring 20' which ring in turn is mounted by bracing to the dish.

The sleeve 23 for the 4 GHZ signal has a signal receiving inlet 23' and a perpendicular outlet 25 which is perpendicular to the center axis of sleeve 23. The outlet 25 has a waveguide 26 mounted thereto for guiding the 4 GHZ signal into the amplification system 21, which amplification system is mounted to the outlet of the waveguide 26 which is conventional in construction.

The sleeve 24 or waveguide for the 12 GHZ frequency signal has two sleeve portions 24' and 24" in telescoping relation. The sleeve portion 24" is fixed to the back of the delection plate 28. The deflection plate 28 is pivotally mounted to the sleeve 23 to pivot from a 45 degree angle with respect to the center axis of the sleeve 23 into parallelism with the center axis of the sleeve 23 about pins 36 and 37, with the sleeve 24 pivoting with the plate 28. The sleeve portion 24' is telescoped outward from the sleeve portion 24" when the plate 23 is pivoted into its parallel position.

The amplification system 22 is mounted to the outlet end 23" of sleeve 23 and has a conventional tubular waveguide receiving portion 29 for receiving the 12 GHZ signal from the waveguide 24 when the waveguide 24 is in its telescoped operative position.

The waveguide mechanism 20 with the amplification system 22 for the 4 GHZ signal and the amplification system 21 for the 12 GHZ signal are mounted to the concave sidee of the signal receiving dish 19 centrally of the dish. The waveguide 23 is mounted permanently so that its center axis coincides with the center axis of the dish 19, and so that the portion of its center axis at its forward edge 30 of its forward end 23' is at the focal point 31 of a reflected signal 50 when reflected from the dish onto the waveguide 23 from a remote microwave transmitter. When the sleeve portion 24' is telescoped outward and pivoted with the plate 28 into the parallel position, its center axis coincides with the center axis of sleeve 23, and its center axis portion at its forward edge 34 of its signal receiving end 35, when viewed from FIGS. 2 and 3, is also substantially at the focal point 31.

The reflecting plate 28 is pivotally mounted to the waveguide 23 by a pair of pins 36 and 37 fixed to the plate 28 and which are pivotally mounted in bores 36' and 37' in the sleeve 23. A lever arm 38 has a pair of lever arm portions 40 and 41 which are pivoted together at their one ends at pivot point 39. The other end of lever arm portion 40 is fixed to shaft 42. The shaft 42 is rotatably mounted in a pair of brackets 42' and 43', which brackets are fixed to the outside of sleeve 23. A reversable motor 44 has its output shaft 44' fixed to the shaft 42 whereby activation of the motor in one direction rotates the shaft 42 counter clockwise and pivots arm portion 40 forward, when viewed from FIGS. 2 and 3,; and the activation of the motor in the opposite direction pivots the lever arm 40 clockwise rearward. The other end of lever arm portion 41 is pivotally mounted to sleeve 24' at pivot point 41' so that the activation of the motor in the counterclockwise direction, which causes the lever arm portion 40 to pivot forward, raises arm portion 41 upward and into a straightened position with respect to arm 40 by pivoting clockwise forward with respect to portion 40. The outer end of the lever arm 41 being pivotally mounted to the sleeve portion 24' at pivot point 41', in being moved forward forward by lever 40, raises and telescopes sleeve 24' and pivots both portions of sleeve 24 and plate 28 at the same time, until the forward edge 34 of sleeve 24' is even with the forward edge of sleeve 23, with its center axis coinciding with the center axis of sleeve 23 as illustrated in phanton lines in FIGS. 2 and 3.

OPERATION

The mechanism 20 operates as follows:

The satellite dish 19 will be set in a convenient location for receiving the microwave signal from a satellite, with the waveguide switching mechanism 20 attached to the dish along with the amplification systems for the two frequencies. A microwave signal 50 will be received by the dish and reflected into the waveguide 23 at its focal point 31.

If the microwave signal it is desired to receive and amplify is the 4 GHZ frequency, the motor 44 will be activated to pivot the plate 28 about its pivots 36 and 37 to its 45 degree angle illustrated in solid lines in FIGS. 2 and 3. When the 4 GHZ signal is received in the dish, it will be reflected to the focal point 31 at the upper edge 23' of the sleeve 23. Since the center axis of sleeve 23 coincides with the center axis of the dish, the signal will be uniformly concentrated at this focal point, and from there it will travel down the sleeve 23, and since the deflection plate is pivoted to a 45 degree angle across the sleeve, the plate 28 will then deflect the signal so that it will travel out the outlet 25 into the conventional waveguide 26 and then into the amphlification system 21. The amplification system may be activated to amphlify the signal to transmit the signal by cable to a remote television receiver for example.

Since the pivoting of plate 28 to its 45 degree angle was caused by the retraction of the sleeve 24' into the sleeve 24", and since the sleeve 24 is now retracted behind the plate 28, this enables the 4 GHZ signal to be transmitted through the sleeve 23 and deflected directly into the amplification system 21 without the 12 GHZ waveguide 24 interfering with the transmission of the 4 GHZ signal.

When it is desired to switch the receiving apparatus from the 4 GHZ frequency to a frequency of 12 GHZ, to receive a signal of that frequency; the operator will activate the motor 44 to drive the shaft 42 counterclockwise when viewed from FIG. 2, The rotation of the shaft 42 counterclockwise moves forward or telescopes the sleeve portion 24' out of sleeve 24", by the shaft pivoting the lever 38 forward and the pivoting of the lever 38 upward pivots the lever 40 forward clockwise straightening out lever 40 in relation to lever 38 until they are in their position shown in solid lines in FIG. 2 and phanton lines in FIG. 2 and also telescopes the sleeve 24' forward until its forward edge 34 is even with the forward end 23 of sleeve with their center axes in coaxial relation. The action of the levers 38 and 40, in pivoting the sleeve 24', also acts to pivot the plate 28 and the sleeve portions 24" and 24' into their parallel position with regard to the center axis of sleeve 23, by the plate 28 pivoting about pins 36 and 37.

Since the parallel positioning of sleeves 24" and 24' and the telescoping action has placed the forward edge of sleeve 24' even with sleeve 23, with their center axes in coaxial relation, the portion of the center axis of sleeve 24 at its forward edge 34 when viewed from FIG. 5 coincides with the focal point 31 of the signal reflected from the dish, the 12 GHZ signal will travel into the sleeve portion 24' along its center axis and into sleeve portion 24" and out of sleeve portion 24" into the conventional waveguide receiving portion 29, which has a slanted forward edge so that the sleeve poriton can pivot into coaxial relation when parallel positioned with its reversly slanted rearward edge, for amplification by the amplification system 21 which may be activated to amplify the signal so that it can be transmitted by cable to a remote television receiver for example.

Thus it will be seen that a novel waveguide switching apparatus has been provided which enables a waveguide of 12 GHZ and 4 GHZ frequency to be aligned coincident with the focal point of a signal when reflected off of a dish onto a fixed focal point without one waveguide interfering with the other.

The movement of the 12 GHZ waveguide to a retracted position and at the same time pivoting to angle behind the deflection plate enables the 12 GHZ waveguide to be positioned out of the way so as not to interfere with the 4 GHZ waveguide, while the 4 GHZ waveguide with its center axis portion at it forward signal receiving end coinciding with the focal point. Conversely, the 12 GHZ waveguide can be pivoted and telescoped into a positio where its center axis portion at its forward signal receiving end coincides with the focal point without the 4 GHZ interfering with the operation of the 12 GHZ waveguide.

The dish may be of conventional shape, either spherical or parabolic, for example.

A slot 45 is provided in the sleeve 23 for the arm 40 to extend therethrough.

It will be obvious that various changes and departures may be made to the invention without departing from the spirit and scope thereof, and accordingly, it is not intended that the invention be limited to that specifically described in the specification or as illustrated in the drawings, but only as set forth in the appended claims wherein:

What is claimed is:

1. A waveguide switching mechanism for a signal receving apparatus comprising a microwave reflecting dish having a concave surface, a sleeve mechanism mounted to the center of the concave portion of the dish, a first amplification system for amplifying large signals, a second amplification system for amplifying small signals, said sleeve comprising a large sleeve, said large sleeve having an opening at its forward end for receiving a large wave signal collected by said dish and having a lateral opening rearward in the sleeve to allow the large signal to leave the large sleeve, a deflecting plate movably mounted to be positioned at an acute angle diagonally across the large sleeve so that its front face can deflect the large signal laterally out the lateral opening in the large sleeve to be received and amplified by the amplification system for large signals, a pair of small sleeves, one of said sleeves being mounted in telescoping relation to the other with the other small sleeve fixed to the back face of the deflecting plate, said small sleeves having their center axes parallel to the plane of the back face of the deflecting plate, levering means having one end connected to said one small sleeve, means to move said levering means whereby said levering means acts to position said one small sleeve retracted into the other small sleeve when the plate is diagonally across the large sleeve to facilitate the diagonal positioning of the plate, said levering means acting to lever said one small sleeve forward from said retracted position with said forward levering movement of the one small sleeve telescoping said one small sleeve forward of the other while pivoting the plate into parallel alignment with the center axis of the large sleeve and pivoting the small sleeves on the plate so that their axes are pivoted into concentric alignment with the axis of the large sleeve with the forward end of the one small sleeve adjacent the forward open end of the large sleeve so that the small sleeves may guide a small signal centrlly through the larger sleeve to the second amplification system for amplification of small signals.

2. A signal guide device for a signal receiever apparatus comprising a signal reflecting dish, said dish having a concave surface, a signal guide sleeve mechanism mounted to the center of the concave surface portion of the dish to receive signals collected by said dish at its forward end, said mechanism having a large stationary sleeve having an open forward end to recieve a large signal collected by said dish, said large sleeve having a lateral opening rearward of said forward open end for allowing the large signal to leave the sleeve, a pivotally mounted deflection plate pivotally mounted inside the large sleeve adjacent the lateral opening and adapted to be pivoted into a position diagonally across the lrge sleeve to deflect a large signal out of said lateral openng, a first amplification system for amplifying a large signal for amplifying a large signal deflected out of said lateral opening and mounted adjacent said lateral opening, a pair of small sleeves with one mounted to the rear face of said deflecting plate with the longitudinal axes of the small sleeves parallel with the face of said plate, the other of said small sleeves being retractable into the one small sleeve in telescoping relation to the one small sleeve to facilitate the positioning of said deflecting plate diagonally across the large sleeve, a second amplification system for amplifying a small signal mounted rearward of said deflecting plate, lever means having an end portion mounted to said other of said small sleeves whereby movement of said lever means will move said other sleeve forward which will pivot said deflecting plate from its diagonal position into parallel alignment with the longitudinal axis of the large sleeve and will pivot said one small mounted to said plate and said other small sleeve mounted to said one small sleeve into a position where their longitudinal axes are in parallel concentric alignment with the longitudinal axis of the large sleeve and telescope said other small sleeve forward until its forward end is adjacent the forward open end of the small sleeve for receiving a small signal collected by said dish through said small sleeves into the second amplificaiton system for amplifying the small signal.

* * * * *